US006209771B1

(12) United States Patent
Lyons et al.

(10) Patent No.: US 6,209,771 B1
(45) Date of Patent: Apr. 3, 2001

(54) APPARATUS FOR ATTACHING A SECURITY TAG

(76) Inventors: Richard A. Lyons, 7301 N. Lafayette Rd., Indianapolis, IN (US) 46278; Denise D. Sosbe, 427 E. Pearl St., Lebanon, IN (US) 46052; Emily L. Abel, 7656 Inkbush Dr., Nineveh, IN (US) 46164

( * ) Notice: Subject to any disclaimer, the term of this patent is extended or adjusted under 35 U.S.C. 154(b) by 0 days.

(21) Appl. No.: 09/048,687

(22) Filed: Mar. 26, 1998

(51) Int. Cl.[7] ..... A44B 9/00

(52) U.S. Cl. ..... 227/15; 119/156; 340/568; 340/572; 70/59

(58) Field of Search ..... 227/67, 15, 18, 227/156, 119; 340/568, 572; 70/59, 57.1; 227/16, 17

(56) References Cited

U.S. PATENT DOCUMENTS

| | | | | |
|---|---|---|---|---|
| 3,911,534 | | 10/1975 | Martens et al. . | |
| 4,007,537 | * | 2/1977 | Silverbush et al. | 227/18 |
| 4,012,813 | | 3/1977 | Martens et al. . | |
| 4,278,194 | * | 7/1981 | Ersoy | 227/18 |
| 4,436,238 | * | 3/1984 | Seki | 227/15 |
| 4,531,264 | | 7/1985 | Minasy . | |
| 4,596,349 | * | 6/1986 | Herten | 227/119 |
| 4,603,453 | | 8/1986 | Yokoyama . | |
| 4,694,984 | * | 9/1987 | Altwicker | 227/156 |
| 4,985,987 | * | 1/1991 | Schmidt et al. | 227/15 |
| 5,319,848 | * | 6/1994 | Schmidt et al. | 227/18 |
| 5,345,220 | | 9/1994 | Wachsman . | |
| 5,426,419 | | 6/1995 | Nguyen et al. . | |
| 5,528,914 | | 6/1996 | Nguyen et al. . | |

* cited by examiner

*Primary Examiner*—Scott A. Smith
(74) *Attorney, Agent, or Firm*—Woodard, Emhardt, Naughton, Moriarty & McNett, Patent and Trademark Attorneys

(57) ABSTRACT

The present invention relates to an apparatus for securing a security tag to an article. In one embodiment, the main body portion of the security tag is fixtured in a head while the fastener portion of the security tag is positioned within a fastener-driving unit. The fastener-driving unit is actuated to drive the fastener through the article and into locking engagement with security tag main body portion. In one embodiment, the fastener-driving unit is powered by a solenoid. Another form of the apparatus for securing a security tag to an article utilizes a pivoting lever to drive the security tag main body portion into locking engagement with the fastener portion of the security tag.

10 Claims, 4 Drawing Sheets

APPARATUS FOR ATTACHING A SECURITY TAG

BACKGROUND OF THE INVENTION

The present invention relates generally to a method and apparatus for coupling security tags, used to control inventory and/or prevent theft, to articles. More particular, the present invention has one application wherein a first portion of the security tag is fixtured in an apparatus, and a second portion of the security tag is drawn into locking engagement with the first portion. Although, the present invention was developed for use in the soft goods industry, certain applications may be outside of this field.

The use of various electronic and other types of theft prevention systems has been widely adopted in the retail environment in order to maintain control over inventory and prevent the unauthorized removal of articles from a particular area or from the establishment itself. In the clothing and soft goods industry, a security tag is often attached to each article placed on display for sale. Generally, store personnel attach the security tag at the time the article is set out for display, or the security tag may have been attached when the articles were received in inventory.

A typical security tag includes a body having a fastener-receiving portion. A fastener is then inserted through the article and into the fastener-receiving portion in order to fasten the security tag to the article. Security tag systems are typically configured to prevent or discourage removal of the security tag by unauthorized parties. For example, many security tag designs require a special tool or detaching mechanism to decouple the security tag from the article. In some security tag systems the unauthorized removal of the security tag will result in damage to the article. Further, in other security tag systems, the security tag includes an electronic sensor that will beep or make a sound upon removal of the fastener from the body of the security tag.

Security tags have proven to be an effective method for preventing theft and controlling inventory in the retail-merchandising environment. However, in many instances the fastening of the security tags to the inventory is a time-consuming and tedious task. Presently, the attachment of security tags to an article is generally performed through the manual pressing of the fastener and body together by the store personnel. The task is a repetitive manual task, which may divert the store personnel from other responsibilities, such as tending to customers or managing the operation of the store.

There is a continuing need for an improved method and apparatus for attaching security tags to various articles. The present invention satisfies these and other needs in a novel and unobvious way.

SUMMARY OF THE INVENTION

One embodiment of the present invention contemplates an apparatus for coupling a security tag having a body portion and a fastener portion to an article. The apparatus, comprising: a first member adapted for receiving and holding one of the body portion and the fastener portion; and a second member abutting the other of the body portion and the fastener portion, and wherein at least one of said members is moveable relative to the other of said members so as to place the fastener portion in frictional engagement with the body portion.

Another embodiment of the present invention contemplates a method for coupling a security tag to an article. The method comprising: fixturing the main body portion of the security tag to a first member; placing the fastener in an abutting relationship with a second member; and moving one of the members relative to the other member so as to cause the interengagement of the fastener with the main body portion of the security tag.

An apparatus for coupling a security tag having a body portion and a fastener portion to an article, comprising: a head having a security tag body receiving portion for receiving and holding a security tag body portion; an actuator having a surface for receiving and supporting a fastener thereon; and actuation means for moving the actuator relative to the head so as to drive the fastener into locking engagement with the security tag body portion.

One object of the present invention is to provide a method and apparatus for coupling a security tag to an article.

Related objects and advantages of the present invention will be apparent from the following description.

DESCRIPTION OF THE PREFERRED EMBODIMENT

Figure 1:
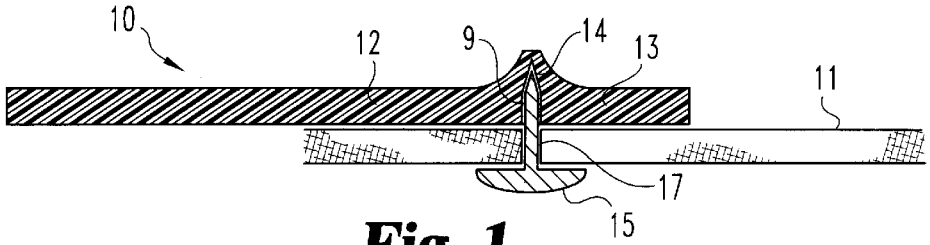
FIG. 1 is an illustrative sectional view of a typical security tag coupled to an article.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described device, and any further applications of the principles of the invention as described herein are contemplated as would normally occur to one skilled in the art to which the invention relates.

With reference to FIG. 1, there is illustrated a sectional view of a secured article, designated generally at 10. Secured article 10 includes an article 11, with a security tag assembly 12 coupled thereto. The security tag assembly 12 includes a main body portion 13 with a fastener receiving opening 14 formed therein, and a fastener 15. The fastener 15 has a male portion 17 which is extendable through the article 11 to securely engage the fastener receiving opening 14 of security tag main body portion 13. In the preferred embodiment the fastener 15 defines a pin. Security tags are generally well known to one skilled in the art and are not intended to be limited herein to the security tag shown in FIG. 1. Many forms of security tags are commercially available and they have a multitude of geometric shapes, sizes and a variety of fastener styles.

The security tag 12 may cause an alarm to sound, beep, spray ink when tampered with, and/or do other things to deter people from the unauthorized movement of articles. The term article 11 as used herein includes any type of goods to which a security tag 12 may be affixed. Typically, the security tag 12 is attached to articles such as clothing, linen, and other types of soft goods. However, the security tag 12 may also be coupled to the packaging of various other articles, which packaging may be referred to as an article carrier. The present invention is applicable for coupling security tags 12 to virtually any type of article 11 as known to one ordinary skill in the art.

Figure 2:
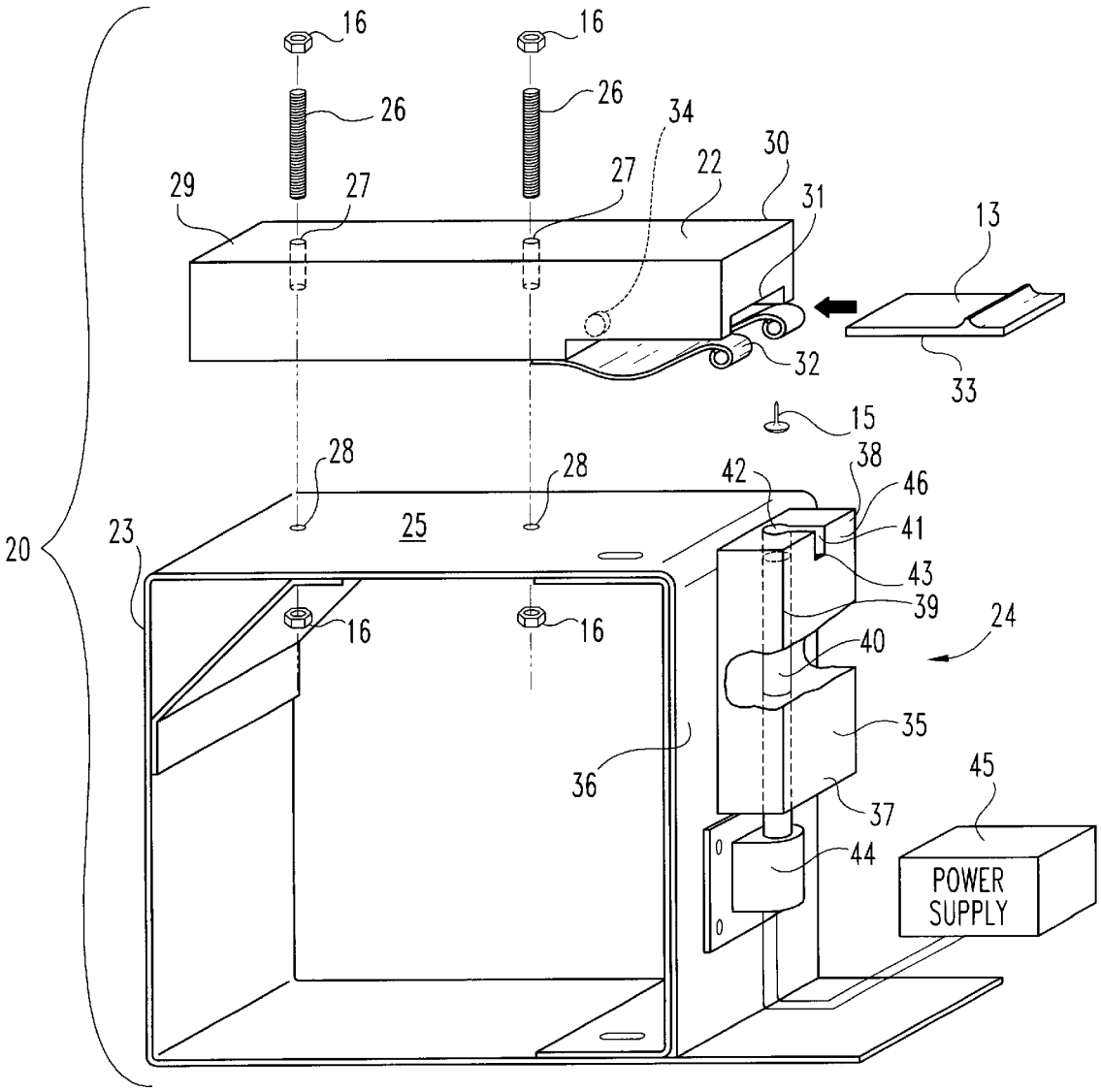
FIG. 2 is a partially exploded view of one embodiment of the present invention comprising an apparatus for coupling a security tag to an article.
Figure 3:
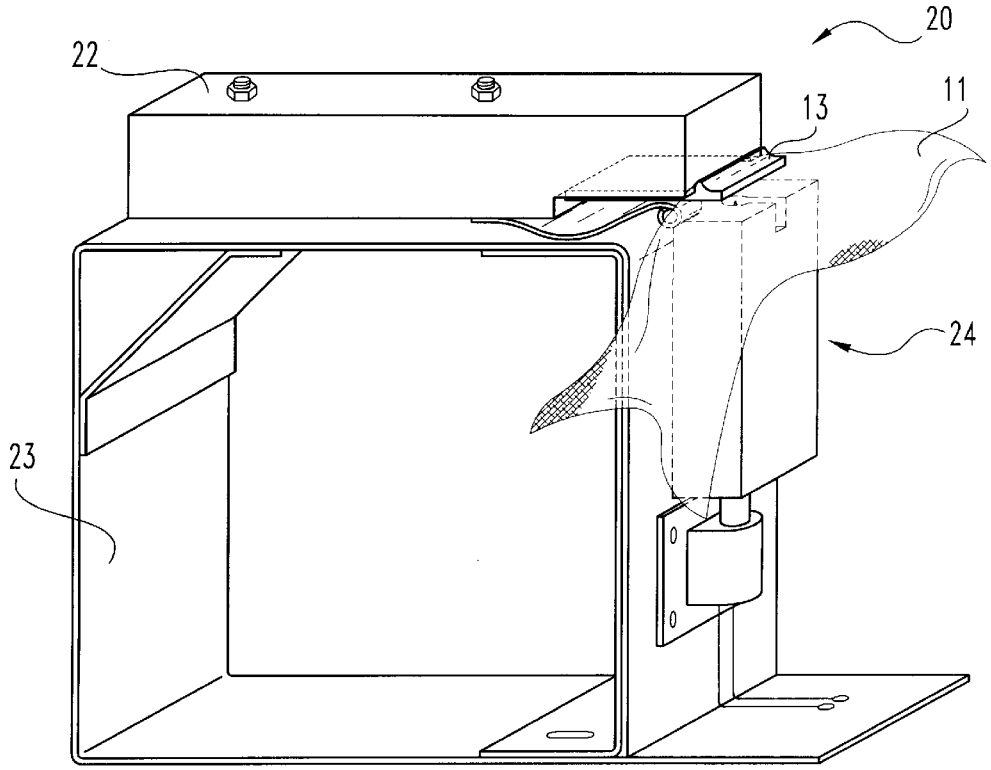
FIG. 3 is a perspective view of the FIG. 2 apparatus with an article positioned for receiving a security tag.
Figure 4:
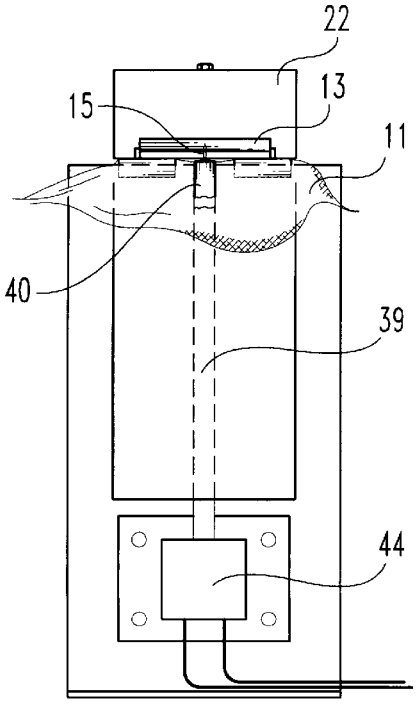
FIG. 4 is a front elevational view of the FIG. 3 apparatus wherein the security tag has been coupled to the article.

Referring to FIGS. 2–4, there is illustrated an apparatus 20 for securing fastener 15 to the security tag main body portion 13. The apparatus 20 includes a head 22, a frame 23 and a fastener driver 24. The frame 23 is a substantially rigid structure for supporting the components of the apparatus. While the frame 23 is illustrated as a fabricated structure it may be formed of sheet metal, metal plates, wood members, plastic pieces, integrally cast or a combination of the above. The design and construction of the supporting frame can take any of a multitude of forms which are believed within the contemplation of a person of ordinary skill in the art.

In one embodiment, head 22 is coupled to a platform portion 25 of support 23 via a pair of fasteners 26 and nuts 16. However, in alternate embodiments the number of fasteners is not limited to a pair and can be one or more. Each of the fasteners 26 extend through a hole 27 defined in head 22 and continue through a hole 28 formed in the platform 25. The fasteners 26 may be threaded studs, bolts, screws, clips, or any other fastening mechanism capable of securing head 22 to platform 25. In the preferred embodiment, head 22 is readily removable so as to be interchangeable with alternate heads (not shown). The interchangeable alternate heads being configured to receive and fixture different types of security tag main body portions 13 thereby allowing flexibility in applying the present invention to a variety of security tags. In one alternate embodiment, head 22 is not interchangeable with other heads, and thus may be permanently fastened to frame 23. The head 22 may be welded, brazed, pinned, or coupled in other fashions so as to permanently attach the head to the frame. 23.

Head 22 has a first end 29 and an opposite other second end 30. In a preferred embodiment a relief 31 is formed in the second end 30 to receive the security tag body portion 13. The relief 31 is configured to slidingly receive the security tag body portion 13 therein. A spring biasing member 32 is coupled to the head 22 so as to apply pressure to the bottom surface 33 of the security tag body portion 13 and normally retain it against the head 22. In the preferred embodiment, the spring biasing member is a leaf spring. The head 22 configuration is not limited to one having a relief 31 formed therein. One alternate embodiment utilizes a head without a relief portion, and the spring biasing member 32 forcing the security tag body portion 13 against the head. Another form of the head 22 includes a pair of opposing slots for receiving and holding the edges of the security tag body portion 13 therein. It is contemplated herein that heads having a variety of configurations so as to allow the use with a multitude of security tags would be useable with the present invention either in an interchangeable mode and/or a dedicated non-interchangeable mode.

In a preferred embodiment a sensor 34 is coupled to the apparatus 20 for sensing when a security tag body portion 13 is positioned in head 22 at the desired location for attaching to the article. The sensor may be located at other positions proximate the head 22. In the preferred embodiment the sensor 34 is a mechanically actuated switch, however the sensor may be an interlock sensor, pressure sensor, optical, or any type of sensor known in the art capable of sensing the position of security tag body portions 13 relative to the head 22. Further, the present invention can also be utilized without a sensor.

In the preferred embodiment the fastener driver 24 includes a carrier 35 coupled to an upstanding wall member 36 of the frame 23. The carrier 35 has a first end 37 and an opposite other second end 38 with a bore 39 extending therebetween. The bore 39 is configured to slidingly receive a plunger/actuator 40 therein. In the preferred embodiment the plunger/actuator 40 is defined as a push rod. Carrier 35 has a loading slot 41 formed therein that is in communication with the bore 39. The loading slot 41 allows for the placement of a fastener 15 therein and movement of it into the bore 39. The plunger/actuator 40 is positioned in a first mode such that the upper surface 42 of the plunger/actuator 40 is parallel with the surface 43 of the loading slot 41. In an alternate embodiment the upper surface 42 of the plunger/actuator 40 can be at different elevations relative to the loading slot 41. However, the change in the relative elevations may require the adjustment of the length of the plunger/actuator 40 and the travel associated therewith. Further, in an alternate embodiment, the loading slot 41 is not formed in the carrier and the fastener 15 is positioned within the bore 39 by top feeding the fastener from the opening at the second end 38.

A plunger actuation means 44 for moving the plunger/actuator between the first mode and a second mode for forcing the fastener 15 into engagement with the wall surfaces 9 (FIG. 1) forming the fastener receiving opening 14. The fastener 15 forming a locking frictional engagement with the main body portion 13 during the movement of the plunger/actuator in the second mode. In a preferred form of the present invention the plunger actuation means 44 are coupled to the wall member 36 of frame 23. In one embodiment the plunger actuation means 44 is defined as a solenoid electrically coupled to a power source 45. In one embodiment, the solenoid has the following characteristics: 120 volt a.c. with intermittent duty cycle; 315.0 ounce of thrust at ⅛ of an inch extension and 187.0 ounces of thrust at ⅞ of an inch extension; and is a push style with 85 ohms of internal resistance. However, other types and characteristics of solenoids are contemplated herein. The solenoid is operable upon activation of a switch (not illustrated) to cause the plunger/actuator 40 to move from a first mode wherein the fastener is aligned with but spaced from the fastener receiving opening 14, to a second mode wherein the plunger/actuator 40 has moved within the bore 39 to force the fastener 15 into the fastener receiving opening 14. The switch may be positioned proximate apparatus 20 for actuation by hand and/or foot.

The plunger actuation means 44 are disclosed above as being a solenoid, however other embodiments of the plunger actuation means include, but are not limited to, an electric motor coupled to a gear mechanism, a battery pack coupled to a gear mechanism, fluid driven such as by compressed air or hydraulics, a cam system, lever, crank, or gear system. In any event, it is preferred that the head 22 is securely coupled to the frame 23 so as to be substantially immovable relative to the plunger/actuator 40. The present invention also contemplates that the relative position of the head to the carrier 35 can be changed, such as by having the head 22 positioned below the carrier 35. Alternatively, carrier 35 may be mounted on 25 and head 22 mounted on wall member 36. While the above alternatives will require some modification to the operation of the apparatus, and care related to the handling of the fastener 15 and the main body portion 13 the principles of the present invention are equally applicable to these alternative configurations.

In the preferred embodiment the sensor 34 is positioned within relief 31 so as to prevent the movement of plunger/actuator 40 towards the main body 13 of the security tag 12 unless the main body 13 is located in the appropriate position on head 22. The sensor ensures the fastener-receiving portion 14 of the main body 13 is properly aligned with the male portion 17 of the fastener 15. Thereby minimizing and/or preventing the misalignment and improper engagement of the fastener 15 with the main body 13. Typically, most security tags 12 require precise alignment between the fastener receiving portion 14 and the male portion 17 in order for the tag to function properly. However, it is understood herein that the present invention 20 does not require a sensor 34, and in an alternate embodiment does not include one.

With reference to FIGS. 1–4, the operation of the apparatus 20 will now be briefly described. The main body portion 13 of the security tag 12 is positioned within the relief 31 above the spring biasing member. The spring biasing member serving to normally hold the main body portion 13 adjacent the head 22. The fastener 15 is placed through the loading slot such that the fastener 15 is disposed within the bore 39 on top of the upper surface 42 of the plunger/actuator 40. The article 11 is then positioned between the second end 38 of the carrier 35 and the main body portion 13 of the security tag 12. The switch is actuated so as to cause the plunger actuation means 44 to move the plunger/actuator 40 from its first mode into its second mode. As the plunger/actuator 40 moves from the first mode to the second mode the fastener 15 is carried towards the main body portion 13 of the security tag 12. The male portion 17 of the fastener 15 is forced through article 11 and into the fastener-receiving portion 14. The movement of the plunger/actuator 40 places the fastener 15 in frictional locking engagement with the wall member defining the fastener-receiving portion 14. Plunger/actuator 40 is then returned to the first mode proximate the surface of the loading slot 43. The secured article 10 is then removed from the apparatus.

Figure 5:
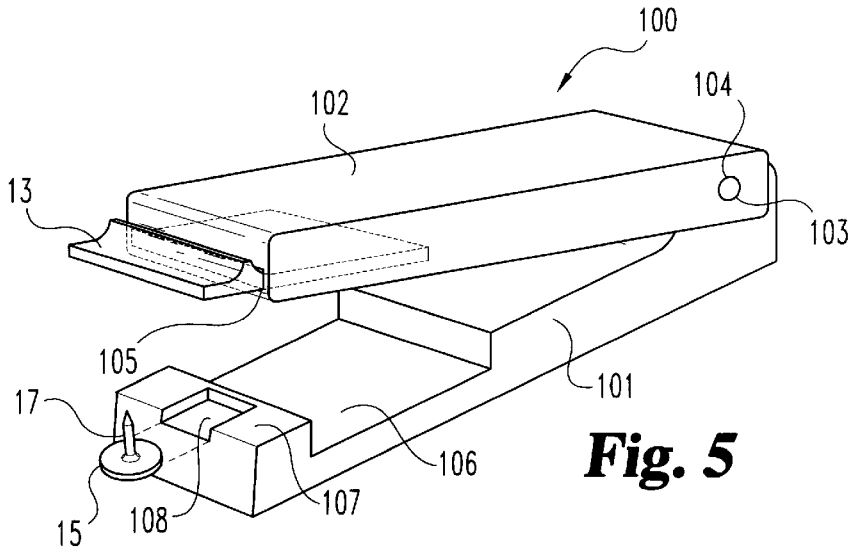
FIG. 5 is a perspective view of an alternative embodiment of the present invention comprising an apparatus for coupling a security tag to an article.

With reference to FIG. 5, there is illustrated an alternative embodiment of the security tag affixation apparatus of the present invention. The apparatus 100 includes a base member 101 and a security tag main body carrying member 102 that are pivotally coupled together. The security tag main body carrying member 102 pivots about a pivot point 103 relative to the base member 101. In the preferred embodiment, a pin 104 functions to couple the base member 101 to the security tag main body-carrying member 102. The security tag main body-carrying member 102 includes a relief 105 for receiving the security tag main body portion 13 therein. In one embodiment, the relief 105 has been sized to receive a particular sized and shaped security tag body portion 13. The relief 105 has been sized so as to position the security tag body portion fastener receiving opening 14 in registry with the male portion 17 of the fastener 15. In an alternative embodiment, the relief 105 is configured so as to receive an insert therein (not illustrated) so as to allow different sized and shaped security tag portions to be used with a universal tool. Thus, the apparatus can have a different insert put into the relief 105 so as to allow different size and shape security tags to be fastened to articles with the apparatus.

The base member 101 having a relief portion 106 to provide clearance for different thickness articles during the coupling of the security tag 12 to the article 11. Positioned at a first end 107 is a fastener receiving and fixturing portion 108. The fastener receiving and fixturing portion 108 having, in a preferred embodiment, a depth, which corresponds to the upstanding thickness of the head of the fastener, portion 15. Further, in an alternative embodiment, the fastener receiving and fixturing portion is contoured and shaped so as to match the geometric profile of the head of the fastener.

Figure 6:
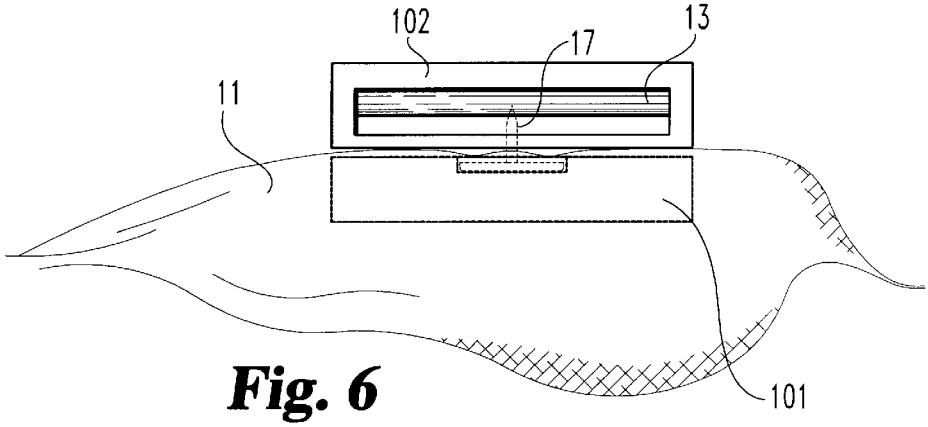
FIG. 6 is an end view of the FIG. 5 apparatus wherein the security tag has been coupled to the article.

With reference to FIG. 6, there is illustrated a front elevational view of the security tag affixation apparatus 100. The apparatus 100 is illustrated in a mode wherein the security tag main body carrying member 102 has been moved downward such that it rotates about pin 104 and drives the security tag main body portion 13 into engagement with the male portion 17 of the fastener 15. The male portion 17 has been securely received within the fastener receiving opening 14. In the preferred embodiment of apparatus 100, the force applied to the security tag main body-carrying member 102 has been applied by the human operator. However, in an alternative embodiment, the force can be applied by a mechanically actuated device such as a cam wherein the eccentric of the cam would force the main body carrying member 102 to rotate about pin 104 and drive the components of security tag into locking engagement. Further, the reversal of the components within FIG. 5 is contemplated herein.

Figure 7:
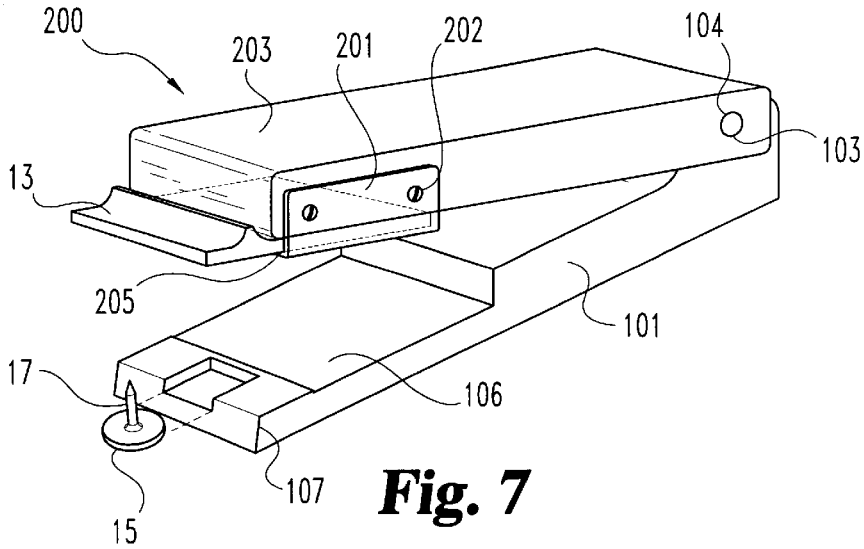
FIG. 7 is a perspective view of an another alternative embodiment of the present invention comprising an apparatus for coupling a security tag to an article.

With reference to FIG. 7, there is illustrated an alternative embodiment of the security tag fixation apparatus. The apparatus 200 is substantially similar to apparatus 100 and like feature numbers will be utilized to indicate like components. A bracket 201 is coupled to the main body-carrying member for receiving and holding the security tag main body portion 13. The bracket 201 is coupled to the security tag main body-carrying member 203 by a plurality of fasteners 202. In a preferred embodiment, the bracket 201 is readily interchangeable so as to allow different sizes and styles of security tags to be utilized with the apparatus 200. The bracket 201 provides a relief 205 for receiving and holding the security tag main body portion 13 therein. Further, the bracket 201 facilitates interchange with other brackets (not illustrated) for added flexibility in using different shapes, sizes and configuration of security tags. The remaining operation of the apparatus 200 is substantially similar to the apparatus 100. Further, the bracket 201 can also be permanently affixed to the security tag main body-carrying member 203.

Figure 8:
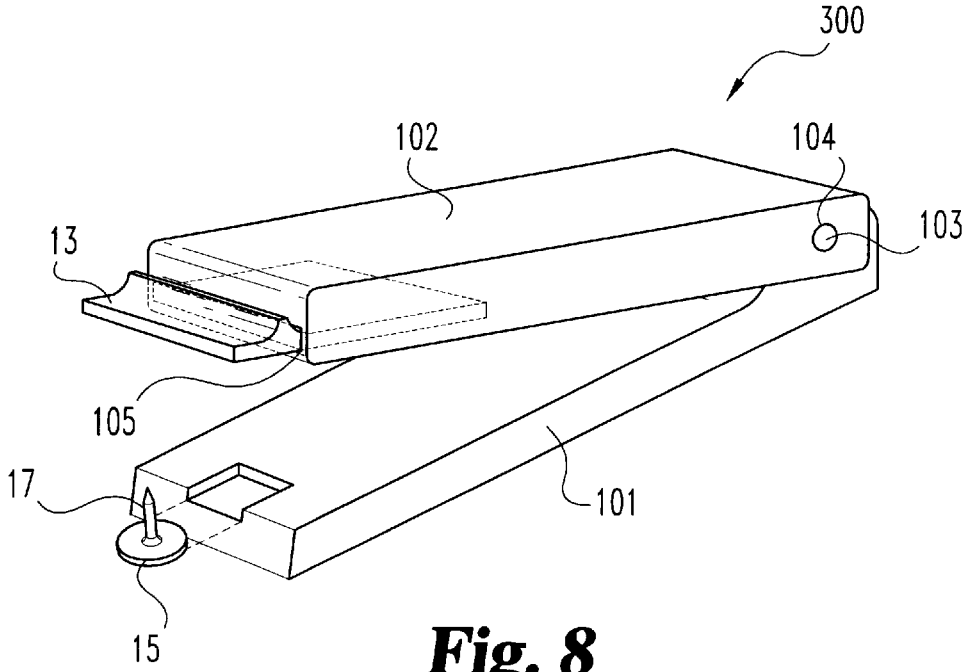
FIG. 8 is a perspective view of an another alternative embodiment of the present invention comprising an apparatus for coupling a security tag to an article.

With reference to FIG. 8, there is illustrated an alternative embodiment of the security tag affixation apparatus of the present invention. The apparatus 300 is substantially identical to the apparatus 100 and like figures will be utilized to represent like components. The substantial difference between the apparatus 300 and the apparatus 100 is that apparatus 300 does not include a relief portion 106. It is further understood that this concept can be applied to other apparatuses such as the one shown in FIG. 7.

Figure 9:
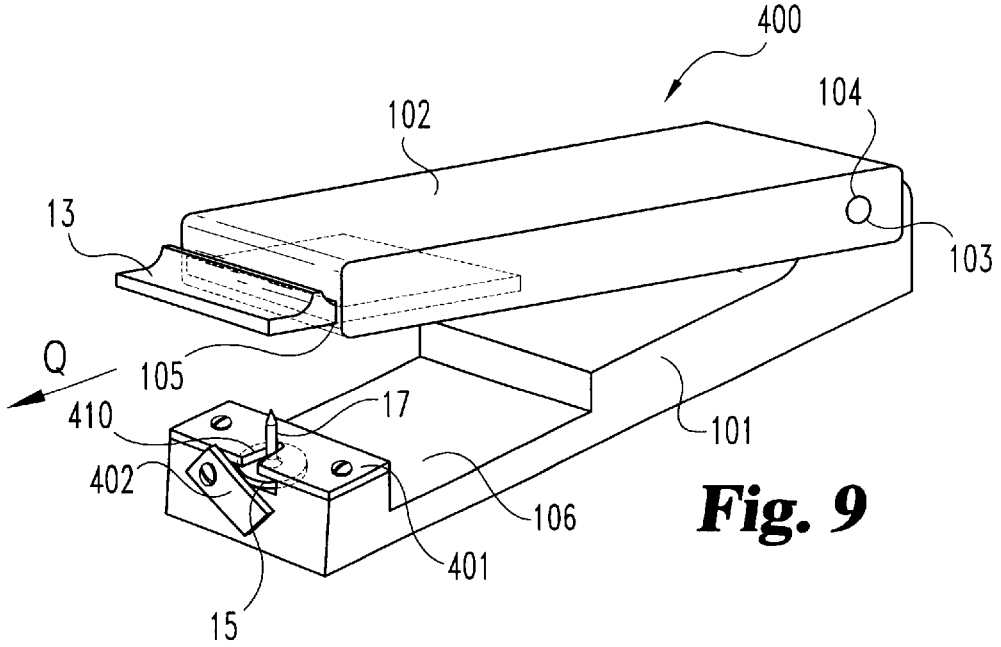
FIG. 9 is a perspective view of an alternative embodiment of the present invention comprising an apparatus for coupling a security tag to an article.

With reference to FIG. 9, there is illustrated an alternative embodiment of the security tag affixation apparatus of the present invention. The apparatus 400 is substantially identical to the apparatus 100 and like figures will be utilized to represent like components. An additional feature of apparatus 400 includes a fastener restraining means 401 and a moveable door 402. In one embodiment, the fastener restraining means 401 includes a slot 410 configured to fit tightly with the male portion 17 of the fastener 15. The door 402 is openable to allow the passage of the fastener 15 into the slot 410. The door 402 may be closed by rotation to prevent the inadvertent removal of the fastener 15 from the slot 410. In operation after the fastener 15 has been secured to the main body portion 13, the entire secured article 10 is withdrawn in the direction of arrow Q to remove the item from the apparatus 400. It is understood herein that the thickness of the fastener restraining means 401 may be adjusted so as to limit the degree of insertion of the fastener 15 into the main body portion 13. Further, the relief 105 accepts and securely holds the main body portion 13.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for coupling a security tag having a body portion and a fastener portion to an article, comprising:

a first member adapted for receiving and holding one of the body portion and the fastener portion, said first member comprising a head portion and a leaf spring portion, said leaf spring portion coupled to the head portion, wherein one of the body portion and the fastener portion is received and held intermediate the head portion and the leaf spring portion; and a second member abutting the other of the body portion and the fastener portion, and wherein at least one of said first and second members is moveable relative to the other of said first and second members so as to cause the fastener portion to be placed in frictional engagement with the body portion.

2. The apparatus of claim 1, which:

further includes a frame member;

wherein said first member and said second member are couple to said frame; and which further includes an actuator coupled to one of said first and second members, and wherein said actuator has a mode wherein said actuator moves said one of said first and second members towards the other of said first and second members.

3. The apparatus of claim 2:

wherein said first member defines a head portion adapted for receiving and holding the body portion, and wherein said first member is connected to said frame;

wherein said second member is moveably coupled to said frame, said second member has a first end adapted for receiving and supporting the fastener portion and a second end;

a solenoid engageable with the second end of the second member and activatable to cause the solenoid member to move from a first mode wherein the fastener portion is spaced from the body portion to a second mode wherein the fastener portion is contacting the body portion.

4. The apparatus of claim 3, which further includes a guide structure connected to said frame for controlling the movement of said second member.

5. The apparatus of claim 4:

which further includes a sensor coupled to said first member for sensing when a body portion is positioned at a predetermined location at said head portion; and wherein said second member is slidable within a bore defined in said guide structure.

6. The apparatus of claim 5, which further includes a spring biasing member coupled to said first member, said spring biasing member adapted to hold the body portion against the first member.

7. An apparatus for coupling a security tag having a body portion and a fastener portion to an article, comprising:

a head having a security tag body receiving portion for receiving and holding a security tag body portion and a leaf spring coupled to the head, wherein said security tag body portion is received and held intermediate the security tag body receiving portion and the leaf spring portion;

an actuator having a surface for receiving and supporting a fastener thereon; and actuation means for moving said actuator relative to said head so as to drive the fastener into locking engagement with said security tag body portion.

8. The apparatus of claim 7:

which further includes a frame structure, and wherein said head is connected to said frame structure and said actuator is moveable relative to said frame structure; and which further includes a guide member coupled to said frame structure for receiving at least a portion of said actuator therein.

9. The apparatus of claim 8:

which further includes means for holding the body portion against a portion of said head; and which further includes a fastener portion restraint associated with said actuator for orienting the fastener portion in a predetermined manner.

10. The apparatus of claim 8, wherein said actuator means includes a solenoid, and wherein said solenoid is electrically coupled to a power source.

* * * * *